US005869195A

United States Patent [19]

Ramanarayanan et al.

[11] Patent Number: 5,869,195

[45] Date of Patent: Feb. 9, 1999

[54] CORROSION RESISTANT CARBON STEEL

[75] Inventors: Trikur A. Ramanarayanan, Somerset, N.J.; Adnan Ozekcin, Bethlehem, Pa.

[73] Assignee: Exxon Research and Engineering Company, Florham Park, N.J.

[21] Appl. No.: 778,532

[22] Filed: Jan. 3, 1997

[51] Int. Cl.[6] ..... B22D 25/00

[52] U.S. Cl. ..... 428/610; 148/270; 148/320; 148/909

[58] Field of Search ..... 428/610; 148/320, 148/328, 909, 270

[56] References Cited

U.S. PATENT DOCUMENTS 3,629,012 12/1971 Kohn ..... 148/270
3,918,923 11/1975 Inoue .
3,998,664 12/1976 Rote ..... 148/322
4,204,031 5/1980 Takemura .
4,230,507 10/1980 Obayashi et al. ..... 148/270
5,290,369 3/1994 Hatano et al. ..... 148/230

*Primary Examiner*—John Sheehan
*Attorney, Agent, or Firm*—Jay Simon

[57] ABSTRACT

Corrosion of conventional refinery steels due to sulfur bearing, carboxylic acid containing hydrocarbon materials is minimized by forming on the surface of the steel a fine grain iron sulfide film where at least the steel surface is substantially all of a pearlite microstructure.

15 Claims, 2 Drawing Sheets

Conventional Steel

Pearlitic Steel

CORROSION RESISTANT CARBON STEEL

FIELD OF THE INVENTION

This invention relates to a composition and a method for handling corrosive hydrocarbon materials, such as crude oils and distillates. More particularly, this invention relates to a composition that minimizes the corrosion of carbon steels normally used in the handling of hydrocarbon containing materials.

BACKGROUND OF THE INVENTION

Carbon steels used in refinery service undergo corrosion by sulfur compounds and carboxylic acids, especially naphthenic acids, present in crudes and distillate fractions. Many newly available crudes have high concentrations of these corrosive species, and as a result, carry a lower cost on a per barrel basis. Consequently, there is an economic incentive in processing these crudes, provided that the material costs, because of corrosion, can be minimized. Highly alloyed steels, such as 316 or 317 stainless steel, are an approach, but these materials are so expensive as to make the processing of acidic, sulfur beating crudes too costly. Therefore, a real incentive exists for processing crudes and distillates containing sulfur and naphthenic acids with relatively inexpensive materials.

SUMMARY OF THE INVENTION

In accordance with this invention, hydrocarbon materials, e.g., crudes and distillate fractions, containing carboxylic acids, such as naphthenic acids, or sulfur compounds or both can be readily processed over carbon steel, plate or pipe, having a FeS (pearlite) surface layer of at least about 300 Angstroms. This fine-grained FeS film has a grain size of about 500 Angstroms or less. Such an FeS film is formed by exposing carbon steel, at least the surface of which has a substantially pearlitic microstructure, to hydrocarbon materials containing sulfur preferably at a level of at least about 0.1 wt. pct. The pearlite/FeS composite surface layer acts to inhibit or substantially minimize corrosion by sulfur compounds or carboxylic acids or both in hydrocarbon materials containing either or both of the same. The thickness of the pearlitic region is preferably at least about 20 microns. The protective FeS film may also be formed by subjecting the steel having at least a substantially surface pearlitic structure to sulfur containing compounds such as hydrogen sulfide.

Figure 1A:
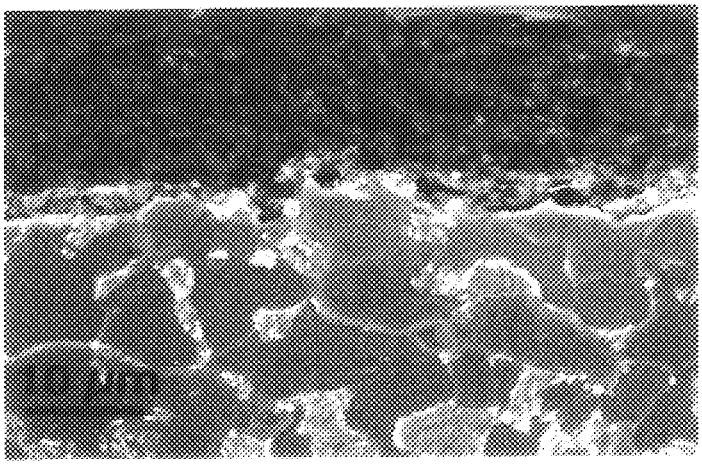
FIG. 1 compares the nature of the FeS film formed on a conventional ferrite/pearlite steel with a FeS film formed on steel having a substantially fully pearlitic surface, when both are exposed to high naphthenic acid, (TAN~8) [Bolobo] crude containing about 0.1 wt. pct. sulfur compounds at a temperature of 600° F. for 20 hours. In the conventional steel (FIG. 1A), the FeS layer formed is very thick (~15 microns), porous and non-protective. In the case of the pearlitic steel (FIG. 1B and FIG. 1C), the FeS film is approximately 1 micron in thickness and is dense and compact. This dense, compact film is made up of extremely fine grains (~300 Angstrom) of FeS and is very protective against corrosion.

For the purposes of this invention, the term FeS (ferrite) will refer to a conventional steel which has a microstructure which is predominantly (70 vol. pct. or more) ferrite, the balance being pearlite. The term FeS (pearlite) will refer to FeS formed on a steel microstructure that is at least about 70 vol %, preferably at least about 90 vol % pearlitic. Ferrite is a phase which has a body-centered cubic crystallographical structure, and is primarily iron with some dissolved carbon. Pearlite is a microstructural constituent that is made up of alternate layers of ferrite and cementite ($Fe_3C$).

Steels used in refinery service are usually comprised of pearlitic and ferritic microstructural constituents, ferrite being the more predominant microstructure. Ferritic grains, however, are easily attacked by carboxylic acids in liquid hydrocarbons. The FeS layer that forms on the ferritic steel in the presence of carboxylic acid-containing liquid hydrocarbons is generally not very protective. Fe atoms from ferrite will migrate through such an FeS film and will be attacked by the hydrocarbon phase, leading to ultimate deterioration of the steel. On the other hand, the FeS film formed on a steel surface that is predominantly pearlitic is fine grained and compact. In such a fine grained sulfide film, Fe atom transport is suppressed because fine grains are generally free from defects that promote atomic migration. Therefore, iron loss from the steel is considerably minimized leading to high corrosion resistance for FeS (pearlite) films.

The grain size of FeS grains when the steel is pearlitic is ≦500 Angstroms, preferably ≦400 Å, Angstroms, and more preferably less than about 300 Å; while the grain size of FeS grains when the steel is predominantly fenitic is ≧1 micron, e.g., 1–2 microns. (One [1] micron is equal to ten thousand [10,000] Angstroms.)

The protective nature of the FeS (pearlite) film starts when the film is at least one grain in thickness, e.g., ≧300 Angstroms, more preferably where the film is ≧400 Å, still more preferably when the film is equal to or greater than about 500 Angstroms. More preferably, the protective FeS (pearlite) film is at least about 0.1 microns, still more preferably at least about 0.5 microns, and yet more preferably at least about 1 micron, for example, 1–2 microns, but generally no more than about 2 microns.

Preferred carbon steels used in this invention have carbon content at least at the surface and preferably throughout, of at least about 0.7 wt % carbon, more preferably ≧0.75 wt %, still more preferably about 0.75–1.0 wt % carbon. Of course, other alloying agents may be present to provide other qualities useful in steels for refinery service. Other alloying agents may be Mn, Si, etc. A widely used refinery steel, for example, contains 0.14–0.20 wt %. C, 0.6–0.9 wt %. Mn, 0.035 wt %. P, 0.04 wt %. S, the remainder being iron. A silicon containing grade, has in addition, 0.1–0.5 wt % Si.

Conventional steels may be transformed from ferrite-pearlite microstructure to essentially all pearlite microstructure by known techniques. For example, a conventional ferritic-pearlitic steel with at least 0.7 wt % C may be heated to the austenitic recrystallization range, above about 900° C., for about an hour or more, after which the steel is transferred to an oven at about 675° C. for at least ½ hour or more where pearlitic transformation begins to take place. The steel is allowed to cool in the oven, cooling is quite slow, the result being essentially complete transformation to pearlite. For the present invention, the pearlitic microstructure is preferably ≧90%, more preferably ≧95%, and still more preferably ≧99%, and most preferably 100% pearlite.

Alternatively, only the surface e.g. at least about 1 micron thickness, of the steel need be of the pearlitic microstructure.

Pearlitic surface layers can also be formed by well known methods in a carburizing environment; for example, heating the steel to ≧900° C. in the presence of appropriate mixtures of methane and hydrogen which allows carbon to diffuse into the steel surface. Preferably, the carburized steel is heated to the austenitic recrystallization temperature and cooled, as described above, to allow the formation of a surface layer of pearlitic microstructure.

In the case of forming a surface layer of pearlite, only the surface layer need contain carbon of ≧0.7 wt %, and preferably the carbon contents mentioned above, in order for the pearlitic microstructure to form on the surface.

By virtue of this invention, hydrocarbon materials such as crudes, topped crudes, atmospheric resids, vacuum resids, etc. may be processed over a steel, at least the surface of which contains the desired pearlitic microstructure. The FeS (pearlite) film will form and act to protect the steel from sulfur or carboxylic acid corrosion. Generally, these hydrocarbon containing materials have at least about 0.1 wt % sulfur and up to about 4 wt % sulfur if the material is a whole or topped crude. Carboxylic acids, including naphthenic acids, when present in these materials are usually described by their total acid number (TAN). The TAN of a material is determined by the number of milligrams of potassium hydroxide (KOH) necessary to neutralize the acids in one gram of material. This invention can effectively accommodate materials having a TAN ranging from about 0.1–8; however, the incentives for using this invention increase as the TAN increases, and the invention is particularly applicable to materials having a TAN in excess of about 2.0, preferably in excess of about 3.0.

The following examples will serve to illustrate, but shall not be construed as limiting, this invention:

A conventionally used carbon steel material 1018 which is made up of a mixture of ferrite and pearlite phases was subjected to corrosion by a crude containing a relatively large concentration of naphthenic acid (TAN ~8) and a relatively smaller concentration of organic sulfur molecules (~0.12%). The test was carried out in a stirred autoclave at a temperature of 600° F. for a period of 20 hours. Two separate tests that were carried out show excellent reproducibility. The average corrosion rate was 130 mils per year (mpy).

Carbon steel containing 0.75% carbon was purchased and appropriate heat treatment (consisting of heating the steel to 900° C., maintaining at this temperature for ½ hour, quenching to 675° C., holding at this temperature for ½ hour and furnace cooling to room temperature) carried out to form a fully pearlitic microstructure. Electron microscopy studies confirmed that a structure that is completely pearlite was formed. The steel was subjected to the same corrosion tests as the conventional carbon steel. Again, a set of two experiments was carried out. The results were reproducible and showed an average corrosion rate of 20 mpy. Thus the use of fully pearlitic carbon steel reduced the corrosion rate by a factor of 6.5.

Figure 1B:
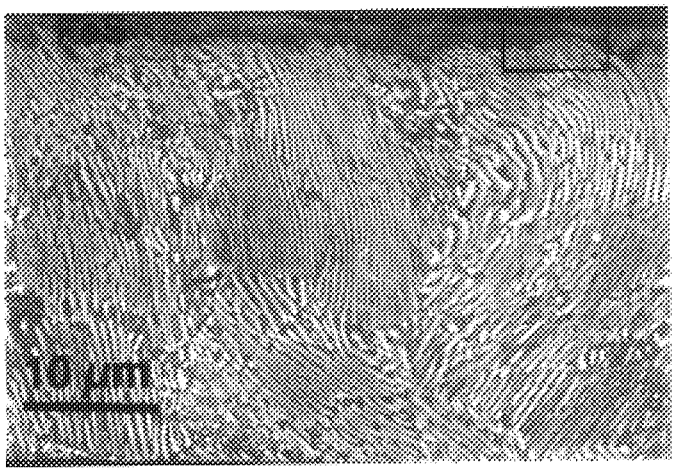
Figure 1C:
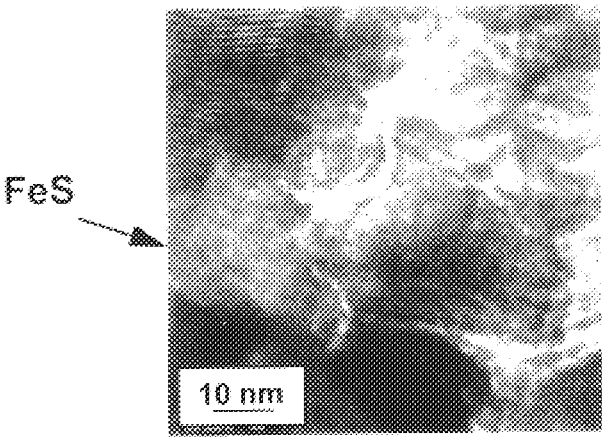
Figure 2:
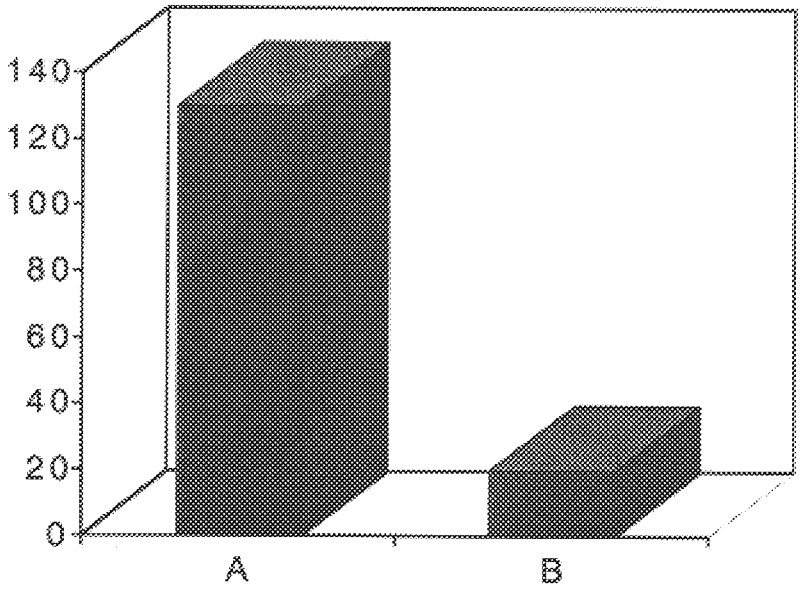
FIG. 2 is a graph comparing the corrosion rate of a conventional ferrite/pearlite steel with a pearlitic steel when exposed to conditions described for FIG. 1. The corrosion rate of the conventional steel (A) is ~130 mpy. The corrosion rate of the pearlitic steel (B) is ~20 mpy which is a factor of 6.5 lower. This drastic reduction in the corrosion rate is attributed to the fine-grained FeS film.

The above results are shown in FIGS. 1 and 2. In the conventional steel some sulfidation has occurred, but more importantly, grains have been pulled out by naphthenic acid attack. Also, the ferritic grains tend to dissolve whereas the pearlitic grains in the conventional steel remain resistant to further attack. The fully pearlitic steel microstructure shows low corrosion rate and remains intact after corrosion, only a thin sulfide film is evident on the surface. Corrosion by naphthenic acid has been significantly suppressed and that by sulfin species reduced.

We claim:

1. A corrosion minimizing steel composition comprising an FeS (pearlite) surface film of at least about 300 Angstroms thickness.

2. The composition of claim 1 wherein the carbon content of the steel is at least about 0.7 wt %.

3. The composition of claim 1 wherein the steel microstructure is at least about 70 vol % pearlite.

4. The composition of claim 1 wherein the steel microstructure is at least about 90 vol % pearlite.

5. The composition of claim 2 wherein the FeS (pearlite) film is at least about 0.1 microns thickness.

6. The composition of claim 3 wherein pearlitic microstructure at the surface is at least about 20 microns thickness.

7. The composition of claim 4 wherein the FeS (pearlite) film is at least about one micron thickness.

8. The composition of claim 4 wherein the Fe(S) (pearlite) grain size is about 500 Angstroms or less.

9. The composition of claim 1 wherein the film is not more than about 2 microns in thickness.

10. A method for reducing the corrosivity of carbon steel comprising passing a sulfu containing material in contact with a steel of ≧70% pearlite microstructure for a time sufficient to form thereon a film of FeS (pearlite)of at least 300 Angstroms thickness.

11. The process of claim 10 wherein a whole or topped crude or distillate containing naphthenic acid is passed over the carbon steel having the FeS (pearlite) film.

12. The process of claim 10 wherein the sulfur containing material is a whole or topped crude or distillate having a sulfur content of at least about 0.1 wt %.

13. The process of claim 10 wherein the steel microstructure is at least about 90 vol % pearlite.

14. The process of claim 12 wherein the FeS (pearlite) film is at least about 0.1 microns thickness.

15. The process of claim 14 wherein the FeS (pearlite) film is at least about 1 micron thickness.

* * * * *